US007018524B2

(12) United States Patent
McAdams et al.

(10) Patent No.: US 7,018,524 B2
(45) Date of Patent: Mar. 28, 2006

(54) REFORMULATED DIESEL FUEL

(75) Inventors: Hiramie T. McAdams, Carrollton, IL (US); Robert W. Crawford, Tucson, AZ (US); Gerald R. Hadder, Oak Ridge, TN (US); Barry D. McNutt, Arlington, VA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 202 days.

(21) Appl. No.: 10/359,213

(22) Filed: Feb. 6, 2003

(65) Prior Publication Data

US 2005/0173299 A1 Aug. 11, 2005

(51) Int. Cl.
*C10L 1/08* (2006.01)

(52) U.S. Cl. ..... 208/15; 44/300; 585/14

(58) Field of Classification Search ..... 44/300; 208/15; 585/14

See application file for complete search history.

(56) References Cited

U.S. PATENT DOCUMENTS

| | | | | | |
|---|---|---|---|---|---|
| 5,389,112 | A | | 2/1995 | Nikanjam | 44/300 |
| H1553 | H | * | 7/1996 | Pedersen | 44/268 |
| 5,792,339 | A | * | 8/1998 | Russell | 208/15 |
| 5,976,201 | A | * | 11/1999 | Barry et al. | 44/413 |
| 6,004,361 | A | * | 12/1999 | Barry et al. | 44/413 |
| 6,150,575 | A | * | 11/2000 | Angevine et al. | 585/14 |
| 6,265,629 | B1 | * | 7/2001 | Fava et al. | 585/14 |
| 6,291,732 | B1 | * | 9/2001 | Hubbard et al. | 585/14 |
| 6,461,497 | B1 | | 10/2002 | Pedersen | 208/15 |
| 6,500,329 | B1 | * | 12/2002 | Tsao et al. | 208/59 |
| 6,663,767 | B1 | * | 12/2003 | Berlowitz et al. | 208/15 |

OTHER PUBLICATIONS

California Air Resources Board. 2002. Diesel Fuel Program, "Certified ARB Alternative Diesel Formulations," http://www.arb.ca.gov/fuels/diesel/diesel.htm, 1001 "I" Street, P.O. Box 2815, Sacramento, CA 95812, Oct. 25.

Energy and Environmental Analysis. 2001. "Diesel Technology and Fuel Requirements for Low Emissions: Phase II," prepared for UT-Battelle, Oak Ridge National Laboratory under Contract 62X-SM489C, Task 18, May.

Graboski, M.S., R.L. McCormick, T.L. Alleman, and A.M. Herring. 2000. The Effect of Biodiesel Composition on Engine Emissions from a DDC Series 60 Diesel Engine, Final Report to National Renewable Energy Laboratory under Contract No. ACG-8-17106-02, Jun. 3. McCormick, R.L., J.R. Alvarez, and M.S. Graboski. 2001 NOx Solutions for Biodiesel, Final Report to National Renewable Energy Laboratory under Contract No. XCO-0-30088-01, Aug. 24.

(Continued)

*Primary Examiner*—Ellen M. McAvoy
(74) *Attorney, Agent, or Firm*—Emily G. Schneider; Paul A. Gottlieb

(57) ABSTRACT

Reformulated diesel fuels for automotive diesel engines which meet the requirements of ASTM 975-02 and provide significantly reduced emissions of nitrogen oxides ($NO_x$) and particulate matter (PM) relative to commercially available diesel fuels.

56 Claims, 5 Drawing Sheets

OTHER PUBLICATIONS

ASTM. 2002. Standard Specification for Diesel Fuel Oils, D 975-02, 100 Barr Harbor Drive, P.O. Box C700, West Conshohocken, PA 19428-2959. ASTM. 2002. Standard Specification for Biodiesel Fuel (B100) Blend Stock for Distillate Fuels, D 6751-02, 100 Barr Harbor Drive, P.O. Box C700, West Conshohocken, PA 19428-2959.

Mason, R.L. and J.P. Buckingham. 2001. Diesel Fuel Impact Model Data Analysis Plan Review. SwRI 08.04075, Draft Final Report prepared for Environmental Protection Agency, 2000 Traverwood, Ann Arbor, MI 48105, Jul., 2001, http://www.epa.gov/otaq/models/analysis/hdd-swri.pdf.

Texas Natural Resource Conservation Commission. 2000. Chapter 114—Control of Air Pollution from Motor Vehicles, Rule Log No. 2000-011D-114-A1, http://www.t-nrcc.state.tx.us/oprd/rule_lib/ad00011d.pdf.

* cited by examiner

Figure 1. Group 1 Diesel Fuels
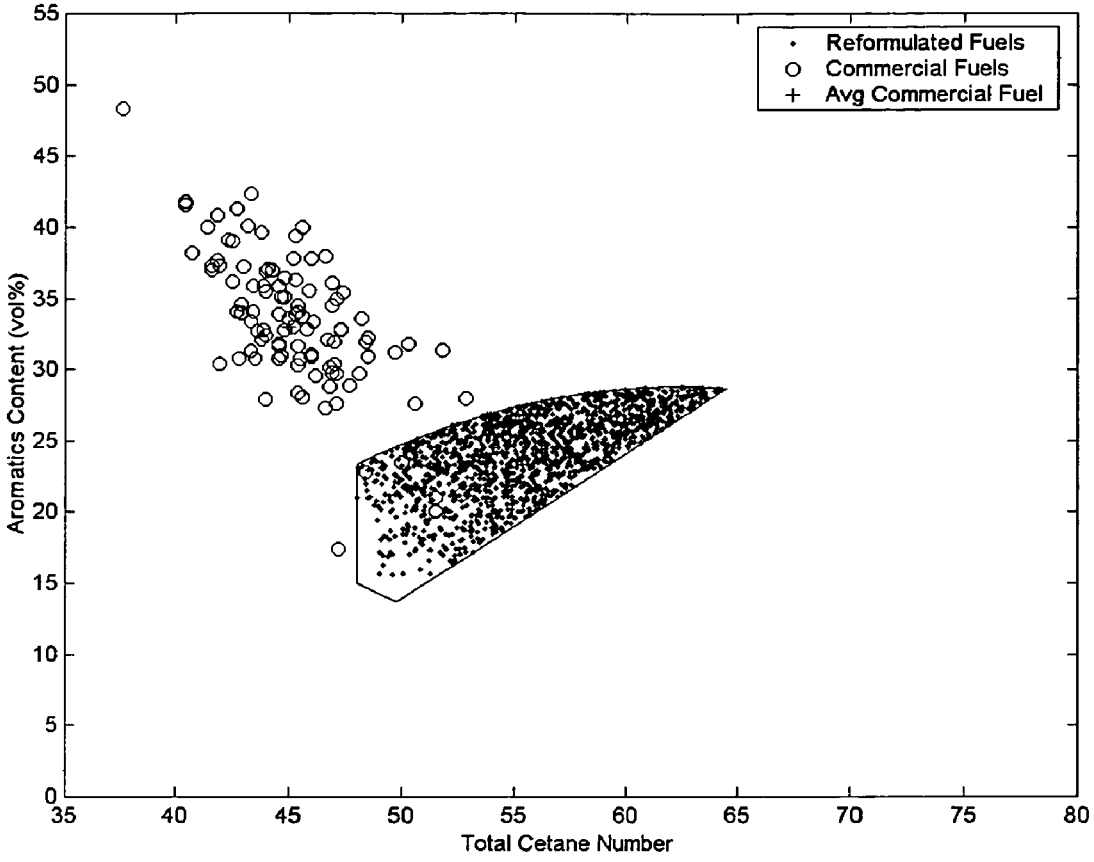

REFORMULATED DIESEL FUEL

This invention relates to diesel fuels and more particularly to reformulated diesel fuels for automotive diesel engines meeting the requirements of ASTM 975-02 *Standard Specification for Diesel Fuel Oils* and providing significantly reduced emissions of nitrogen oxides ($NO_x$) and particulate matter (PM). The United States Government has rights to this invention pursuant to Contract No. DE-AC05-00OR22725, awarded by the U.S. Department of Energy.

BACKGROUND OF THE INVENTION

The potential for reformulating diesel fuel to reduce emissions is of considerable current interest. In 1993, the State of California established a reformulation program with emissions performance standards for diesel fuel in an effort to reduce emissions of $NO_x$, PM and air toxics. More recently, the State of Texas proposed a similar diesel fuel program, and other states have considered such programs.

The attractiveness of diesel fuel reformulation to state authorities stems from the potential for achieving emissions reductions from the in-use vehicle fleet, predominantly heavy-duty diesel (HDD) engines. Other parties, including engine and vehicle manufacturers, may have interest in diesel fuel reformulation (beyond sulfur reductions) to enable new emission control technologies or to improve vehicle operating characteristics.

In response to the interest in diesel fuel reformulation, the U.S. Environmental Protection Agency (EPA) initiated a research effort to relate diesel fuel characteristics to HDD emissions. Relying on the compilation of emissions test data already published in the technical literature, the agency developed statistical models for exhaust emissions as functions of fuel properties such as aromatics content, specific gravity, and cetane number. The EPA work is summarized in two publications hereby incorporated in their entirety by reference: U.S. Environmental Protection Agency. 2001. *Strategies and Issues in Correlating Diesel Fuel Properties with Emissions: Staff Discussion Document* EPA420-P-01-001 (hereinafter "U.S. EPA 2001") and Southwest Research Institute. July 2001. *Diesel Fuel Impact Model Data Analysis Plan Review*. SwRI 08.04075 (hereinafter "SwRI 2001"). This EPA work was presented at a public workshop in August 2001. Although recognized for contributions to the understanding of these issues, the results of the EPA effort evoked considerable discussion and some controversy in terms of statistical methodology, selection of variables, and model predictions. EPA subsequently concluded the work without adopting an approved statistical model of emissions for regulatory use.

Accordingly, a need in the art exists for reformulated diesel fuels for automotive diesel engines which meet the requirements of ASTM 975-02 and provide significantly reduced emissions of nitrogen oxides ($NO_x$) and particulate matter (PM) relative to commercially available diesel fuels.

SUMMARY OF INVENTION

In view of the above need, it is an object of this invention to provide reformulated diesel fuels that meet the requirements of ASTM 975-02 for use in automotive diesel engines.

It is another object of the present invention to provide reformulated diesel fuels for heavy-duty diesel engines which provide significantly reduced emissions of nitrogen oxides and particulate matter relative to commercially available diesel fuels.

According to the present invention, a reformulated diesel fuel meeting the requirements of ASTM 975-02.and having the following properties is provided: a total cetane number in a range from about 48 to about 75; a cetane improvement number of less than or equal to 20; a minimum aromatics content ($Arom_{min}$) determined as a function of the total cetane number (TCet) by the formula: $Arom_{min}=15.00-0.7143*[min(55,TCet)-48]$; a maximum aromatics content ($Arom_{max}$) determined as a function of the total cetane number (TCet) by the formula: $Arom_{max}=-76.21+3.375*TCet-0.02712*TCet^2$; a sulfur content less than or equal to 500 ppm; and an oxygen content not to exceed the naturally-occurring oxygen content of the fuel.

Also provided in the present invention is a reformulated oxygenated diesel fuel meeting the requirements of ASTM 975-02 and having the following properties: a total cetane number in a range from about 48 to about 75; a cetane improvement number of less than or equal to 20; a minimum aromatics content ($Arom_{min}$) determined as a function of the total cetane number (TCet) by the formula: $Arom_{min}=15.00-0.7143*[min(55,TCet)-48]$; a maximum aromatics content ($Arom_{max}$) determined as a function of the total cetane number (TCet) by the formula: $Arom_{max}=-134.28+5.168*TCet-0.04051*TCet^2$; a sulfur content less than or equal to 500 ppm; and an oxygen content less than or equal to 1.0 weight percent.

Further, the present invention is a reformulated oxygenated diesel fuel meeting the requirements of ASTM 975-02 and having the following properties: a total cetane number in a range from about 48 to about 75; a cetane improvement number of less than or equal to 20; a minimum aromatics content ($Arom_{min}$) determined as a function of the total cetane number (TCet) by the formula: $Arom_{min}=15:00-0.7143*[min(55,TCet)-48]$; a maximum aromatics content ($Arom_{max}$) determined as a function of the total cetane number (TCet) by the formula: $Arom_{max}=-171.68+6.139*TCet-0.04641*TCet^2$; a sulfur content less than or equal to 500 ppm; and an oxygen content in a range from greater than 1.0 to 2.0 weight percent.

In addition, the present invention comprises a reformulated oxygenated diesel fuel meeting the requirements of ASTM 975-02 and having the following properties: a total cetane number in a range from about 49 to about 75; a cetane improvement number of less than or equal to 20; a minimum aromatics content ($Arom_{min}$) determined as a function of the total cetane number (TCet) by the formula: $Arom_{min}=14.50-0.7500*[min(55,TCet)-49]$; a maximum aromatics content ($Arom_{max}$) determined as a function of the total cetane number (TCet) by the formula: $Arom_{max}=163.37+5.687*TCet-0.04200*TCet^2$; a sulfur content less than or equal to 500 ppm; and an oxygen content in a range from greater than 2.0 to 3.0 weight percent.

The present invention also is a reformulated oxygenated diesel fuel meeting the requirements of ASTM 975-02 and having the following properties: a total cetane number in a range from about 52 to about 75; a cetane improvement number of less than or equal to 20; a minimum aromatics content ($Arom_{min}$) greater than or equal to 10 volume percent; a maximum aromatics content ($Arom_{max}$) determined as a function of the total cetane number (TCet) by the formula: $Arom_{max}=178.25+5.930*TCet-0.04270*TCet^2$; a sulfur content less than or equal to 500 ppm; and an oxygen content in a range from greater than 3.0 to 3.5 weight percent.

Additional objects, advantages, and novel features of the invention will be set forth in part in the description which follows, and in part will become apparent to those skilled in the art upon examination of the following or may be learned by the practice of the invention. The objects and advantages may be realized and attained by means of the instrumentalities and combinations particularly pointed out herein and in the appended claims.

BRIEF DESCRIPTION OF THE DRAWINGS

The accompanying drawings, which are incorporated in and form a part of the specification, illustrate preferred embodiments of the invention, and together with the description, serve to explain principles of the invention.

FIG. 1 is a scatterplot graph showing the relationship of aromatics content to total cetane number in Group 1 reformulated diesel fuels in comparison to a sample of 104 commercial diesel fuels.

DETAILED DESCRIPTION

Figure 2A:
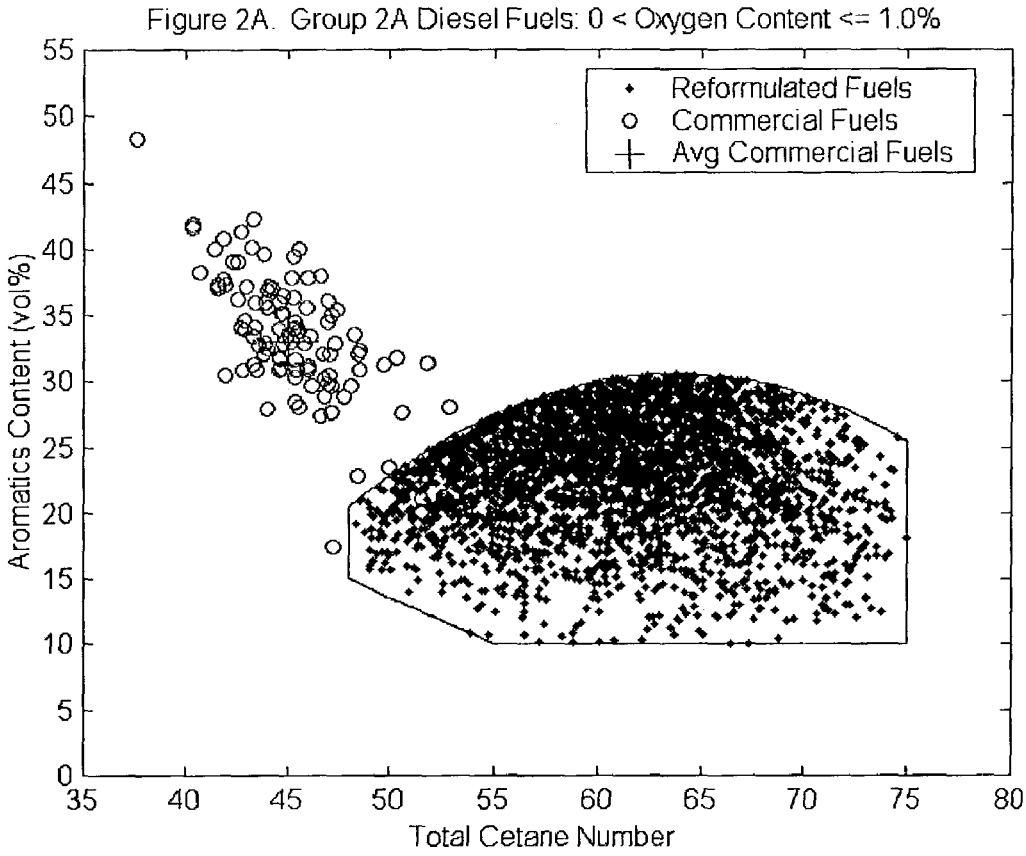
FIG. 2A is a scatterplot graph showing the relationship of aromatics content to total cetane number in Group 2A reformulated oxygenated diesel fuels in comparison to a sample of 104 commercial diesel fuels.

"Reformulated oxygenated diesel fuel", as used in the specification and claims, means reformulated diesel fuel containing oxygenated compounds ("oxygenates"). "Oxygenated compounds ("oxygenates")", as used in the specification and claims, means chemical compounds containing oxygen that are suitable for blending into petroleum blendstocks for the purpose of manufacturing a diesel fuel meeting the specifications of ASTM 975-02. Oxygenated compounds are added during the blending process and are separate and distinct from naturally-occurring oxygen content.

"Naturally-occurring oxygen content", as used in the specification and claims, means the oxygen content present in the finished fuel which existed in the petroleum prior to refining or resulted from the manufacture of the fuel from the petroleum.

"Average commercial diesel fuel", as used in the specification and claims, means a diesel fuel meeting the requirements of ASTM 975-02 and having a total cetane of 45 numbers, a cetane improvement of 0 numbers, an aromatics content of 33 volume percent, an oxygen content not exceeding the naturally-occurring oxygen content, a specific gravity of 0.850 gm/cm$^3$, a sulfur content of 350 ppm, an initial boiling point of 349° F., a 10 volume percent boiling point of 429° F., a 50 volume percent boiling point of 513° F., a 90 volume percent boiling point of 607° F., and a final boiling point of 653° F.

"Cetane Improvement Number", as used in the specification and claims, means the increase in a fuel's total cetane rating, as measured by ASTM D 613, that results from the blending of commercially available cetane additives (ignition improvers).

Oak Ridge National Laboratory (ORNL) has been involved in the analysis of diesel fuel and emissions issues on behalf of the U.S. Department of Energy (DOE) since 1998. ORNL's involvement was motivated by the understanding that diesel fuel reformulation could have substantial impacts on U.S. fuel supply and should be undertaken only on the most reliable technical assessment of benefits and costs. The ORNL work has involved refinery impact studies, emissions test data analysis, and the development of improved statistical methodologies for assessing the relationship between diesel fuels and emissions.

One outcome of this work has been the development of a statistical methodology called Principal Components Regression Plus (PCR+) for use in diesel fuels and emissions research as an alternative to the conventional research paradigm. Conventionally, experimental diesel fuels are blended in an effort to vary selected properties in isolation from each other. Stepwise regression is then used as a primary technique to select, from among competing statistical emissions models, that model believed to be most appropriate for the analysis of emissions test data.

In the real world, diesel fuels are strongly affected by naturally-occurring relationships among the individual fuel properties, as are all diesel fuel and emissions data in which the relationships have not been eliminated. In this realm, ORNL has concluded that the influential factors for emissions are better described by vector variables (the principal components) that represent fundamental combinations of the fuel properties. PCR+ and its application to diesel fuels and emissions research are described more fully in three recent publications (McAdams, H. T., R. W. Crawford and G. R. Hadder. 2000. *A Vector Approach to Regression Analysis and Its Application to Heavy-Duty Diesel Emissions*. SAE 2000-01-1961 (hereinafter "McAdams 2000a"); McAdams, H. T., R. W. Crawford and G. R. Hadder. 2000. *A Vector Approach to Regression Analysis and Its Application to Heavy-Duty Diesel Emissions*. ORNL/TM-2000/5 (hereinafter "McAdams 2000b") and McAdams, H. T., R. W. Crawford and G. R. Hadder. 2002. PCR+ *in Diesel Fuels and Emissions Research*. ORNL/TM-2002/16 (hereinafter "McAdams 2002"), all three of which are hereby incorporated in their entirety by reference.

The conventional research paradigm in diesel emissions research has many significant shortcomings as demonstrated in McAdams 2002, pp. 9–22. First, emissions do not respond to individual fuel properties acting in isolation, but rather to the composite of simultaneous and correlated changes in many properties that occur when fuels are reformulated. Second, the variables chosen for inclusion in emissions models by statistical procedures such as stepwise regression can be arbitrary in the presence of aliasing (caused by correlations among the variables), inasmuch as there are multiple models that are essentially equivalent in explanatory power when gauged by statistical measures such as the Coefficient of Determination ($R^2$). Third, conventional procedures do not correct the problems caused by correlated predictors, but merely consolidate the aliased effects of other variables under the names of the variables retained in the predictive model. The causal relationships between predictors and response are thereby obscured and confused. Finally, aliasing among inter-related predictors casts doubt on whether the final model selected by conventional procedures emphasizes the "most important" or the "right" variables. If it does not, then the model will be unreliable as a basis for fuel improvement.

In PCR+, emissions analysis is conducted in the space of eigenvectors, where the vector variables are explicitly defined to be orthogonal and where model-building is subject to little or no ambiguity caused by aliasing. Orthogonality of predictors eliminates the problems inherent in conventional procedures and provides a unique means for assessing the relative importance of fuel properties. Orthogonality also eliminates variance inflation and thereby provides maximum discrimination among variables through tests of significance that have maximum power.

Further, PCR+ identifies and harnesses the natural structure of correlations that exist among diesel:fuel properties as a result of the characteristics of petroleum blendstocks and the effects of refining processes. In this environment, where fuel properties do not vary independently, it is more reasonable to believe that the eigenvector variables exert independent, causal effects on emissions than to attribute the effects to individual fuel properties. As shown in McAdams 2002, pp. 15–20, PCR+ provides a much more reliable basis for assessing the emissions characteristics of diesel fuels than does the conventional research paradigm.

The PCR+ methodology was used in the present invention to develop reformulated diesel fuels that provide significantly reduced emissions of $NO_x$ and PM when combusted in heavy-duty diesel engines. These fuels are expected to provide comparable emissions reductions in other automotive applications.

With respect to the reformulated diesel fuels of the present invention, the PCR+ methodology was used to develop statistical models that predict the emissions of $NO_x$ and PM from the population of HDD engines currently on the road as a function of diesel fuel characteristics. Then, the predictive models were combined with a complementary analysis of the fundamental characteristics of commercial diesel fuels to identify specific groups of emissions-reducing diesel fuels that are producible in petroleum refineries. These groups are discussed in greater detail below.

The predictive emissions models were developed using a database (U.S. EPA 2001) of emissions testing of HDD engines published as of 2001. A subset of ten different engine technology groups (approximately 70 percent of the database) was selected; these engine groups represent the dominant technology types on the road. Test data for fuels of 750 ppm sulfur or less were retained to better represent the lower sulfur levels of current and future diesel fuels. The resulting subset contained 707 emissions tests, on 36 different HDD engines, for which $NO_x$ and PM emissions and the twelve fuel properties shown in Table I had been measured.

TABLE I

Fuel Properties used to Describe Diesel Fuels

| Fuel Property | Units | ASTM Test Method |
|---|---|---|
| Natural Cetane | number | D 613 |
| Cetane Difference | number | D 613 |
| Specific Gravity | $gm/cm^3$ | D 1298 |
| Viscosity | $mm^2/sec$ | D 445 |
| Sulfur Content | ppm | D 2622, D 129 |
| Total Aromatics Content | volume percent | D 1319 |
| IBP | Fahrenheit degrees | D 86 |
| T10 | Fahrenheit degrees | D 86 |
| T50 | Fahrenheit degrees | D 86 |
| T90 | Fahrenheit degrees | D 86 |
| FBP | Fahrenheit degrees | D 86 |
| Oxygen Content | weight percent | D 5291 |

The process of the predictive model development follows the methodology laid out in prior publications previously incorporated herein by reference (McAdams 2000a, McAdams 2000b and McAdams 2002). The dependent variable in the predictive models was the logarithm of emissions after the effect of individual engines on emissions was removed from the data. The variable space was defined by the choice of the twelve linear fuel property variables shown in Table I and one or more nonlinear terms. The linear fuel properties were used in all cases, while the optimum number of nonlinear terms was identified as a result of the analysis.

Having chosen a variable space containing N total linear and nonlinear terms, the statistical methodology Principal Components Analysis (PCA) was used to define the N eigenvectors that form an orthogonal basis for the space, thereby incorporating the nonlinear terms directly in the vectors. The property-based description of fuels was transformed to an eigenvector-based description, and the weights associated with the eigenvectors were then used as the independent fuel variable values in an otherwise conventional multiple regression analysis. The effect of engines on emissions was removed in a first stage regression that re-expressed the emissions test data as deviations from the mean emissions levels of each engine. The effect of fuels was then assessed in a second stage regression conducted on the engine-normalized emissions values.

As is apparent to those skilled in the art, there are two basic methods to incorporate nonlinear terms in a regression model. In the "post normalization" method, variables X and $X^2$ are formed and then independently normalized to mean 0 and standard deviation 1. This method is computationally simple, but X and $X^2$ will exhibit a strong linear correlation when computed over a range of positive values. In the "pre-normalization" method, variable X is first normalized and squared to form $X^2$, which is then renormalized. This method is computationally more complex, but substantially reduces the correlation between linear and nonlinear terms that would otherwise be present. The "pre-normalization" method was chosen here over the competing "post-normalization" approach because it greatly reduced the linear dependence among terms.

The resulting emission models were of the form:

$$\log(E) = A_0 + \sum_{i=1,n} (A_i * W_i) \tag{1}$$

where E is the predicted emissions effect, $\{A_i\}$ are emissions coefficients determined by linear regression analysis and $\{W_i\}$ are the weights associated with the eigenvectors in the eigenvector-based description of the fuels. This model form implies that mass emissions are an exponential function of the summation term:

$$E = E_0 * \exp\left(\sum_{i=1,n} (A_i * W_i)\right) \tag{2}$$

where $E_0$ is the predicted mass emissions rate for the average commercial fuel.

As shown in the prior publications (McAdams 2000b, pp. 87–95), an eigenvector model can be transformed into a mathematically equivalent model that is stated in terms of the original fuel property variables:

$$\log(E) = B_0 + \sum_{i=1,n} (B_i * P_i), \text{ or} \quad (3)$$

$$E = E_0 * \exp\left(\sum_{i=1,n} (B_i * P_i)\right)$$

where $\{B_i\}$ are emissions coefficients and $\{P_i\}$ are the fuel property values referenced to the properties of the average commercial fuel.

Starting with a variable space containing only the twelve linear fuel property variables, an eigenvector model was developed for $NO_x$ and PM using the methods previously described. A total of 21 quadratic and interactive terms were tested individually against the residuals from the best eigenvector model to identify terms that added predictive power. Quadratic ($X_i^2$) and interactive ($X_i*X_j$ for $i \neq j$) terms appearing to contribute to the prediction of emissions were then added to the linear terms to create an augmented variable space. The eigenvector models were updated and additional variables evaluated for inclusion until all of the nonlinear terms that made useful contributions were identified.

The final eigenvector models for $NO_x$ and PM were based on variable spaces of 17 and 19 terms, respectively. As shown in Table II, the variable spaces contain all twelve linear terms plus five and seven nonlinear terms for $NO_x$ and PM, respectively. The predictive models for emissions are documented in Part II of Hadder, G. R., R. W. Crawford, H. T. McAdams, and B. D. McNutt. December 2002. *Estimating Impacts of Diesel Fuel Reformulation with Vector-based Blending*, ORNL/TM-2000/225. Oak Ridge National Laboratory, Oak Ridge, Tenn., hereby incorporated in its entirety by reference.

TABLE II

Terms Contained in Emission Models

| $NO_x$ Model | PM Model |
|---|---|
| Linear Terms | Linear Terms |
| 12 linear fuel properties | 12 linear fuel properties |
| Quadratic Terms | Quadratic Terms |
| Total Cetane$^2$ | Total Cetane$^2$ |
| Sulfur$^2$ | Sulfur$^2$ |
| Aromatics$^2$ | Oxygen$^2$ |
| Interactive Terms | Interactive Terms |
| Cetane Improvement × Specific Gravity | Cetane Improvement × Total Cetane |
| Cetane Improvement × Aromatics | Sulfur × Cetane Improvement |
| | Sulfur × Specific Gravity |
| | Sulfur × Aromatics |

After developing the predictive models described above, we determined the fundamental characteristics of diesel fuels using a database that was developed from a survey of U.S. diesel fuels conducted during the mid-1990's. The database contains 104 fuels, with both seasonal and geographic diversity, and it remains representative of commercial diesel fuels in the current marketplace. A wide range of physical and chemical properties were reported for each fuel. The fuels do not contain cetane additives (ignition improvers) or oxygenates, but other additives (e.g., viscosity improvers) may be present depending on commercial practice.

Using this database, a PCA analysis was conducted to identify the eigenvector structure of commercial diesel fuels. A total of 10 features were identified from the 10 fuel properties that were considered: natural cetane, specific gravity, viscosity, sulfur content, aromatics content, and five points on the distillation curve (IBP, T10, T50, T90, FBP). Table III summarizes the five primary characteristics that account for

TABLE III

Structure of Commercial Diesel Fuels[a]
(representing 95 percent of fuel variation)

| Eigenvector | Fuel Variation (percent) | Description |
|---|---|---|
| 1 | 48 | Light Cycle Oil (or "Back End") Feature: A decrease in aromatics content is associated with increased natural cetane, decreased specific gravity and viscosity, and lower temperatures throughout the distillation curve. These property changes are expected with removal, by distillation, of light cycle oil. Directionally opposite property changes are expected for blending increased percentages of light cycle oil. |
| 2 | 17 | Hydroprocessed Heavy Distillate Feature: Decreases in aromatics and sulfur content are associated with increased natural cetane, increased viscosity, and higher temperatures at the low end of the distillation curve. These property changes may result from blending increased percentages of hydroprocessed (hydrotreated or hydrocracked) heavy distillate. |
| 3 | 13 | Straight-Run Heavy Distillate Feature: A decrease in aromatics content is associated with increased natural cetane, an increased slope to the distillation curve, and increased sulfur content. These property changes may result from increased blending percentages of (unhydrotreated) straight-run heavy distillate. |
| 4 | 9 | Straight-Run Light Distillate Feature: An increase in sulfur content is associated with decreased back end temperatures, but is largely independent of other property changes. These property changes may result from increased blending percentages of (unhydrotreated) straight-run light distillate. |

TABLE III-continued

| Structure of Commercial Diesel Fuels[a] (representing 95 percent of fuel variation) | | |
|---|---|---|
| Eigenvector | Fuel Variation (percent) | Description |
| 5 | 7 | Initial Boiling Point Feature: A vector representing variation in the initial boiling point, largely in isolation from other properties except sulfur content, and apparently representing blending to control flash point. Directionally opposite property changes are expected with reduced blending percentages of straight-run heavy distillate or increased percentages of straight-run light distillate. |

[a]All fuels are clear of cetane additives (ignition improvers) and oxygenates.

95 percent of the variation among fuels. Each vector is described qualitatively in terms of the properties of which it is comprised, the directionality of the relationship between properties, and the strengths of the relationships. The vectors are also given interpretations in terms of the petroleum blendstocks that are associated with the property changes. Two vectors were added to this structure to represent the use of cetane additives (ignition improvers) and oxygenates, giving a combined basis of twelve vectors.

The twelve eigenvectors thus defined form a vector basis for the space of commercial diesel fuels; fuels formulated using this vector basis would be producible in existing refineries using currently available petroleum blendstocks and refining processes. Indeed, as shown in McAdams 2002, pp. 53–58, the vector characteristics can be independently combined in a Monte Carlo simulation process to synthesize diesel fuels that are indistinguishable from producible fuels in terms of average fuel properties, the standard deviation of the properties, and correlations among the properties.

Using this vector basis of diesel fuel characteristics, a Monte Carlo simulation was run to identify emission-reducing diesel fuels within the space of commercial diesel fuels. The process can be described as follows. If the number of vectors was an integer N, then N uniformly-distributed random, values were generated, and used as the weights associated with the N vectors in a new fuel. As a result of uniform sampling, equal weight was given to each basis vector, thereby expanding the range of the simulation to include all diesel fuels that are producible with current petroleum blendstocks and refining processes. Having generated a possible fuel, the emission models were used to predict $NO_x$ and PM emissions from the population of HDD engines. Statistical criteria were applied to determine if the new fuel belonged to the group of emissions-reducing fuels under study. Fuels identified as belonging to the group were then set aside for later evaluation. A large number (typically 10,000) of emissions-reducing diesel fuels were identified by this process for each group that was studied.

While twelve property variables were used to describe fuels, and 17 or 19 variables were used to predict the emissions of the fuels, the existence of strong correlations among the properties indicates that the number of independent variables is much smaller. Therefore, an analysis was conducted for each group to identify a smaller number of fuel property variables that differentiated the group in comparison to other fuels. Correlation analysis and discriminant function analysis were used to identify a reduced set of fuel property variables that were efficient in characterizing each group. Regression analysis and graphical studies were conducted to identify bounding ranges in the identified property values that characterize each group. The results of the final analysis are summarized in Tables IV–VIII and displayed graphically in FIGS. 1–2D.

With respect to the reformulated diesel fuels of the present invention, Group 1 fuels were defined as non-oxygenated diesel fuels that reduce $NO_x$ and PM emissions in HDD engines with at least 95 percent statistical confidence for each pollutant—i.e., the uncertainty in the estimated emission reduction admits at most a 5 percent chance that the fuel did not reduce emissions. Sulfur content was constrained to be less than the 500 ppm limit permitted in EPA regulations for on-road diesel fuels. Fuels generated in the Monte Carlo simulation and meeting these criteria were found to be accurately described by the fuel property specifications in Table IV.

As shown in FIG. 1, these fuels occupy a bounded area in the plane of total cetane number and aromatics content that was found to be distinctively different from that occupied by commercial diesel fuels. The upper bound in this plane represents the trade-off between total cetane number and aromatics content that is essential to achieving emissions reductions in fuel manufacture, while the lower bound represents the practical limits of fuel manufacture using prevailing refining practices. The total cetane number in these fuels was found to range from 48 to 75 numbers, with cetane additives (ignition improvers) used to achieve as much as 20 cetane numbers increase. Specific gravity and the distillation temperatures were found to vary in relationship to total cetane number, aromatics content, and sulfur content, subject to maximum values that are not to be exceeded.

Group 2A reformulated diesel fuels were defined as oxygenated diesel fuels that contain not more than 1.0 percent oxygen by weight and that reduce $NO_x$ and PM emissions in HDD engines with at least 95 percent statistical confidence for each pollutant. Sulfur content was constrained to be less than 500 ppm limit. Fuels meeting these criteria were found to be accurately described by the fuel property specifications in Table V. As shown in FIG. 2A, compared to Group 1 fuels, these fuels occupy an area in the plane of total cetane number and aromatics content that requires a lower maximum aromatics content in fuels with lower total cetane to assure $NO_x$ reductions, but permits an increased maximum aromatics content in fuels with higher total cetane number while still maintaining PM reductions. Specific gravity and distillation temperatures were found to vary in relation to other properties, subject to maximum values that are not to be exceeded.

Group 2B reformulated diesel fuels were defined as oxygenated fuels that contain more than 1.0 percent and not more than 2.0 percent oxygen by weight and that reduce $NO_x$ and PM emissions in HDD engines with at least 95 percent statistical confidence. Sulfur content was constrained to be less than 500 ppm limit. Group 2C reformulated diesel fuels were defined as oxygenated fuels that contain more than 2.0 percent and not more than 3.0 percent oxygen by weight and that reduce $NO_x$ and PM emissions in HDD engines with at least 95 percent statistical confidence, with sulfur content constrained to less than 500 ppm. Group 2D reformulated diesel fuels were defined as oxygenated fuels that contain more than 3.0 percent and not more than 3.5 percent oxygen by weight and that reduce $NO_x$ and PM emissions in HDD engines with at least 95 percent statistical confidence and contain less than 500 ppm sulfur.

Figure 2B:
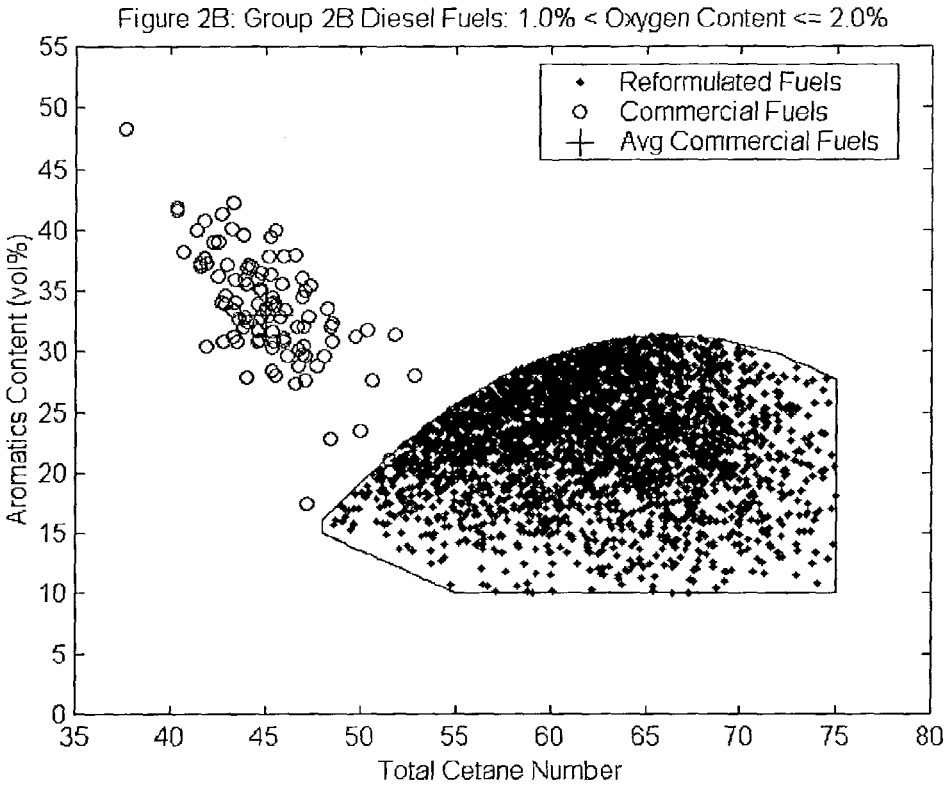
FIG. 2B is a scatterplot graph showing the relationship of aromatics content to total cetane number in Group 2B reformulated oxygenated diesel fuels in comparison to a sample of 104 commercial diesel fuels.
Figure 2C:
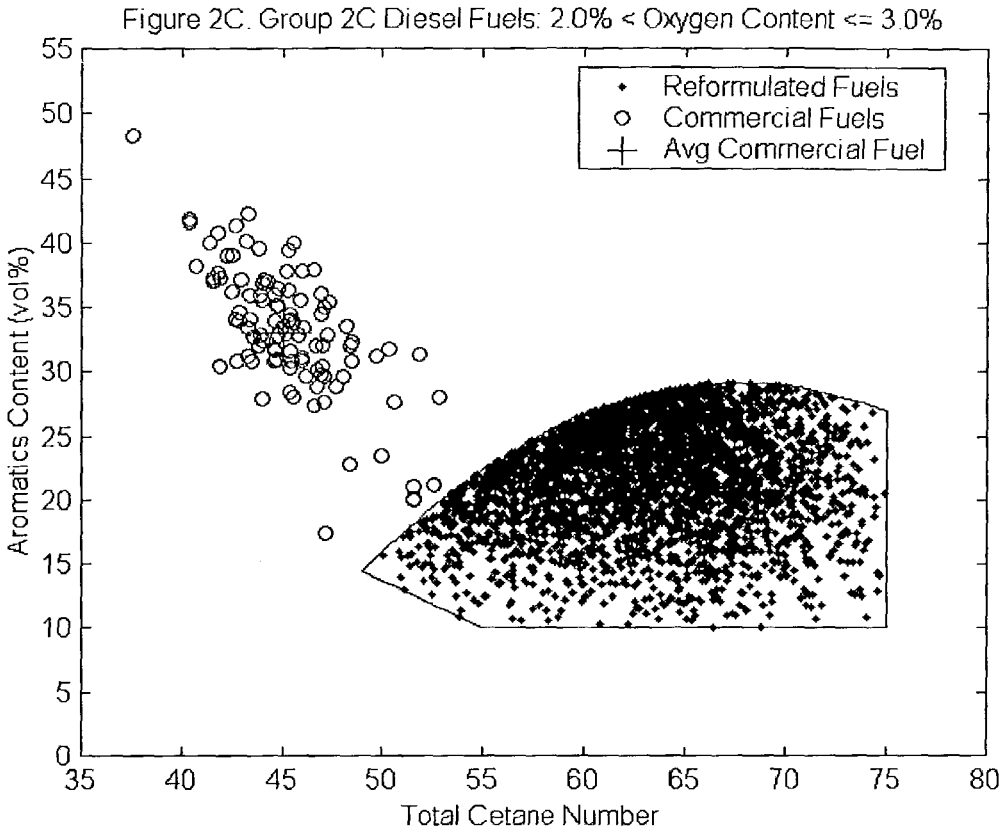
FIG. 2C is a scatterplot graph showing the relationship of aromatics content to total cetane number in Group 2C reformulated oxygenated diesel fuels in comparison to a sample of 104 commercial diesel fuels.
Figure 2D:
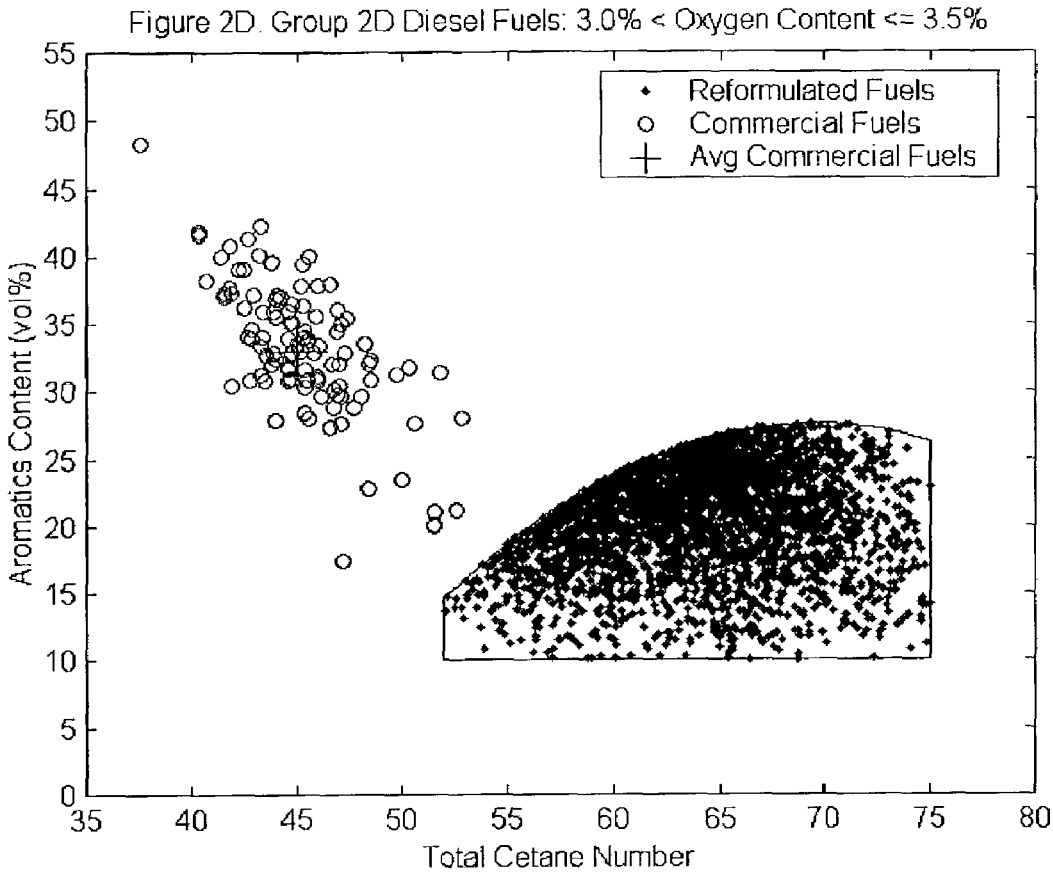
FIG. 2D is a scatterplot graph showing the relationship of aromatics content to total cetane number in Group 2D reformulated oxygenated diesel fuels in comparison to a sample of 104 commercial diesel fuels.

Fuels meeting these criteria were found to be accurately described by the fuel property specifications in Tables VI through VIII, respectively. As shown in FIGS. 2B through 2D, the fuels in each group occupy areas in the plane of total cetane number and aromatics content that require progressively lower maximum aromatics content and higher cetane levels to maintain $NO_x$ emissions reductions, while achieving progressively greater reductions in PM emissions as oxygen content is increased. Specific gravity and distillation temperatures for each group vary in relation to other properties, subject to maximum values that are not to be exceeded.

The diesel fuels claimed in the present invention can be described in terms of the following groups of emissions-reducing diesel fuels:

Description of Group 1 Emissions-Reducing Diesel Fuels

Group 1 Fuels are fuels that substantially reduce $NO_x$ and PM emissions from HDD engines by controlling the total cetane number and aromatics content of the fuel within specified limits, while controlling eight other fuel properties to not exceed stated limits. Group 1 fuels have an oxygen content that does not exceed the naturally-occurring oxygen content of the fuel and are not to be combined with oxygenates. These fuels are estimated to reduce $NO_x$ emissions by amounts ranging from 3 to 12 percent and PM emissions by amounts ranging from 6 to 18 percent compared to the emissions that would result from combusting the average commercial diesel fuel.

Group 1 fuels can be formulated with a total cetane number ranging from 48 to 75 (inclusive) and may use commercially available cetane additives (ignition improvers) to achieve a cetane number increase of as much as 20 numbers. In formulating such fuels, blendstocks are to be chosen such that the total aromatics content of the final fuel does not exceed an upper value $Arom_{max}$ that is a stated function of the total cetane number and such that the values of eight other properties do not exceed stated upper values (see Table IV).

TABLE IV

| Group 1 Clean Diesel Fuels | | | | | |
|---|---|---|---|---|---|
| Emission Benefits | | | | | |
| Reduce HDD $NO_x$ emissions by 3 to 12 percent, and PM emissions by 6 to 18 percent compared to emissions of the average emissions of the average fuel. | | | | | |
| Fuel Property Specifications | | | | | |
| | 48. | <= | Total Cetane Number (TCet) | <= | 75 |
| AND | 0. | <= | Cetane Improvement | <= | 20 |
| AND | Aromatics (vol %) | <= | $-76.21 + 3.375 * TCet - 0.02712 * TCet^2$ | | |
| AND | Aromatics (vol %) | >= | 15.00 − 0.7143 * [min(55, TCet) − 48] | | |
| AND | Oxygen (wt %) | = | Naturally-occurring oxygen content | | |
| AND | Sulfur (ppm) | <= | 500 | | |
| | Specific Gravity ($gm/cm^3$) | <= | 0.861 | | |
| | IBP (° F.) | <= | 439 | | |
| | T10 (° F.) | <= | 490 | | |
| | T50 (° F.) | <= | 570 | | |
| | T90 (° F.) | <= | 640 | | |
| | FBP (° F.) | <= | 712 | | |

Description of Group 2A Emissions-Reducing Diesel Fuels

Group 2A Fuels are oxygenated fuels with oxygen content up to and including 1.0 percent (wt) that substantially reduce $NO_x$ and PM emissions from HDD engines by controlling the total cetane number and aromatics content of the fuel within specified limits, while controlling seven other fuel properties to not exceed stated limits. These fuels are estimated to reduce $NO_x$ emissions by amounts ranging from 2 to 12 percent and PM emissions by amounts ranging from 6 to 18 percent compared to the emissions that would result from combusting the average commercial diesel fuel.

Group 2A fuels can be formulated with a total cetane number ranging from 48 to 75 (inclusive) and may use commercially available cetane additives (ignition improvers) to achieve a cetane number increase of as much as 20 numbers. In formulating such fuels, blendstocks are to be chosen such that the total aromatics content of the final fuel does not exceed an upper value $Arom_{max}$ that is a stated function of the total cetane number and such that the values of seven other properties do not exceed stated upper values (see Table V). Oxygenated compounds are used in amounts appropriate to yield a fuel oxygen content of as much as 1.0 percent (wt).

TABLE V

| Group 2A Oxygenated Diesel Fuels | | | | | |
|---|---|---|---|---|---|
| Emission Benefits | | | | | |
| Reduce HDD $NO_x$ emissions by 2 to 12 percent, and PM emissions by 6 to 18 percent compared to emissions of the average commercial fuel. | | | | | |
| Fuel Property Specifications | | | | | |
| | 48. | <= | Total Cetane Number (TCet) | <= | 75 |
| AND | 0. | <= | Cetane Improvement | <= | 20 |
| AND | Aromatics (vol %) | <= | $-134.28 + 5.168 * TCet - 0.04051 * TCet^2$ | | |
| AND | Aromatics (vol %) | >= | 15.00 − 0.7143 * [min(55, TCet) − 48] | | |
| AND | 0.0 | < | Oxygen (wt %) | <= | 1.0 |
| AND | Sulfur (ppm) | <= | 500 | | |
| | Specific Gravity ($gm/cm^3$) | <= | 0.861 | | |
| | IBP (° F.) | <= | 436 | | |
| | T10 (° F.) | <= | 492 | | |
| | T50 (° F.) | <= | 570 | | |
| | T90 (° F.) | <= | 640 | | |
| | FBP (° F.) | <= | 719 | | |

Description of Group 2B Emissions-Reducing Diesel Fuel

Group 2B Fuels are oxygenated fuels with oxygen content of at least 1.0 percent (wt) and up to and including 2.0 percent (wt) that substantially reduce $NO_x$ and PM emissions from HDD engines by controlling the total cetane number and aromatics content of the fuel,within specified limits, while controlling seven other fuel properties to not exceed stated limits. These fuels are estimated to reduce $NO_x$ emissions by amounts ranging from 2 to 10 percent and PM emissions by amounts ranging from 8 to 22 percent compared to the emissions that would result from combusting the average commercial diesel fuel.

Group 2B fuels can be formulated with a total cetane number ranging from 48 to 75 (inclusive) and may use commercially available cetane additives (ignition improvers) to achieve a cetane number increase of as much as 20 numbers. In formulating such fuels, blendstocks are to be chosen such that the total aromatics content of the final fuel does not exceed an upper value $Arom_{max}$ that is a stated function of the total cetane number and such that the values of seven other properties do not exceed stated upper values (see Table VI). Oxygenated compounds are used in amounts appropriate to yield a fuel oxygen content of greater than 1.0 percent (wt) and as much as 2.0 percent (wt).

TABLE VI

| Group 2B Oxygenated Diesel Fuels | | | | | |
|---|---|---|---|---|---|
| Emission Benefits | | | | | |
| Reduce HDD $NO_x$ emissions by 2 to 10 percent, and PM emissions by 8 to 22 percent compared to emissions of the average commercial fuel. | | | | | |
| Fuel Property Specifications | | | | | |
| | 48. | <= | Total Cetane Number (TCet) | <= | 75 |
| AND | 0. | <= | Cetane Improvement | <= | 20 |
| AND | Aromatics (vol %) | <= | $-171.68 + 6.139 * TCet - 0.04641 * TCet^2$ | | |
| AND | Aromatics (vol %) | >= | 15.00 − 0.7143 * [min(55, TCet) − 48] | | |
| AND | 1.0 | < | Oxygen (wt %) | <= | 2.0 |
| AND | Sulfur (ppm) | <= | 500 | | |
| | Specific Gravity ($gm/cm^3$) | <= | 0.861 | | |
| | IBP (° F.) | <= | 437 | | |
| | T10 (° F.) | <= | 492 | | |
| | T50 (° F.) | <= | 575 | | |
| | T90 (° F.) | <= | 640 | | |
| | FBP (° F.) | <= | 719 | | |

Description of Group 2C Emissions-Reducing Diesel Fuels

Group 2C Fuels are oxygenated fuels with oxygen content of at least 2.0 percent (wt) and up to and including 3.0 percent (wt) that substantially reduce $NO_x$ and PM emissions from HDD engines by controlling the total cetane number and aromatics content of the fuel within specified limits, while controlling seven other fuel properties to not exceed stated limits. These fuels are estimated to reduce $NO_x$ emissions by amounts ranging from 2 to 10 percent and PM emissions by amounts ranging from 14 to 26 percent compared to the emissions that would result from combusting the average commercial diesel fuel.

Group 2C fuels can be formulated with a total cetane number ranging from 49 to 75 (inclusive) and may use commercially available cetane additives (ignition improvers) to achieve a cetane number increase of as much as 20 numbers. In formulating such fuels, blendstocks are to be chosen such that the total aromatics content of the final fuel does not exceed an upper value $Arom_{max}$ that is a stated function of the total cetane number and such that the values of seven other properties do not exceed stated upper values (see Table VII). Oxygenated compounds are used in amounts appropriate to yield a fuel oxygen content of greater than 2.0 percent (wt) and as much as 3.0 percent (wt).

TABLE VII

| Group 2C Oxygenated Diesel Fuels | | | | | |
|---|---|---|---|---|---|
| Emission Benefits | | | | | |
| Reduce HDD $NO_x$ emissions by 2 to 10 percent, and PM emissions by 14 to 26 percent compared to emissions of the average commercial fuel. | | | | | |
| Fuel Property Specifications | | | | | |
| | 49. | <= | Total Cetane Number (TCet) | <= | 75 |
| AND | 0. | <= | Cetane Improvement | <= | 20 |
| AND | Aromatics (vol %) | <= | $-163.37 + 5.687 * TCet - 0.04200 * TCet^2$ | | |
| AND | Aromatics (vol %) | >= | 14.50 − 0.7500 * [min(55, TCet) − 49] | | |
| AND | 2.0 | < | Oxygen (wt %) | <= | 3.0 |
| AND | Sulfur (ppm) | <= | 500 | | |
| | Specific Gravity ($gm/cm^3$) | <= | 0.861 | | |
| | IBP (° F.) | <= | 434 | | |
| | T10 (° F.) | <= | 490 | | |
| | T50 (° F.) | <= | 570 | | |
| | T90 (° F.) | <= | 640 | | |
| | FBP (° F.) | <= | 719 | | |

Description of Group 2D Emissions-Reducing Diesel Fuels

Group 2D Fuels are oxygenated fuels with oxygen content of at least 3.0 percent (wt) and up to and including 3.5 percent (wt) that substantially reduce $NO_x$ and PM emissions from HDD engines by controlling the total cetane number and aromatics content of the fuel within specified limits, while controlling seven other fuel properties to not exceed stated limits. These fuels are estimated to reduce $NO_x$ emissions by amounts ranging from 2 to 9 percent and PM emissions by amounts ranging from 20 to 30 percent compared to the emissions that would result from combusting the average commercial diesel fuel.

Group 2D fuels can be formulated with a total cetane number ranging from 52 to 75 (inclusive) and may use commercially available cetane additives (ignition improvers) to achieve a cetane number increase of as much as 20 numbers. In formulating such fuels, blendstocks are to be chosen such that the total aromatics content of the final fuel does not exceed an upper value $Arom_{max}$ that is a stated function of the total cetane number and such that the values of seven other properties do not exceed stated upper values (see Table VIII). Oxygenated compounds are used in amounts appropriate to yield a fuel oxygen content of greater than 3.0 percent (wt) and as much as 3.5 percent (wt).

TABLE VIII

| Group 2D Oxygenated Diesel Fuels | | | | | |
|---|---|---|---|---|---|
| Emission Benefits | | | | | |
| Reduce HDD $NO_x$ emissions by 2 to 9 percent, and PM emissions by 20 to 30 percent compared to emissions of the average commercial fuel. | | | | | |
| Fuel Property Specifications | | | | | |
| | 52. | <= | Total Cetane Number (TCet) | <= | 75 |
| AND | 0. | <= | Cetane Improvement | <= | 20 |
| AND | Aromatics (vol %) | <= | $-178.25 + 5.930 * TCet - 0.04270 * TCet^2$ | | |
| AND | Aromatics (vol %) | >= | 10.0 | | |
| AND | 3.0 | < | Oxygen (wt %) | <= | 3.5 |
| AND | Sulfur (ppm) | <= | 500 | | |
| | Specific Gravity ($gm/cm^3$) | <= | 0.853 | | |
| | IBP (° F.) | <= | 433 | | |
| | T10 (° F.) | <= | 484 | | |
| | T50 (° F.) | <= | 570 | | |
| | T90 (° F.) | <= | 640 | | |
| | FBP (° F.) | <= | 701 | | |

The above described fuels of the present invention are also shown graphically in FIGS. 1 through 2D. FIG. 1 shows a plot of Group 1 reformulated diesel fuels. The points in the figure are specific fuels that were identified in the Monte Carlo simulation described above. The solid line identifies the bounded area in the plane of total cetane number and aromatics content within which the fuels belonging to the group lie. The upper boundary line represents the essential trade-off between total cetane number and aromatics content that must not be exceeded in the manufacture of the reformulated fuel. The portion of the line at lower cetane numbers is determined predominantly by the constraint of NOx emissions, while the portion at higher cetane numbers is determined predominantly by the constraint of PM emissions. The lower boundary line represents the practical limits of fuel manufacture using prevailing practices in the refining industry, as indicated by the decreasing density of fuel points as the boundary is approached. Boundary lines to the left and right represent lower and upper limits of the total cetane number, which may be achieved in part by the use of cetane additives (ignition improvers) in amounts not to exceed 20 cetane numbers. The reformulated fuels are shown to populate a distinctively different area of the plane than the sample of commercial diesel fuels, for which only 4 of 104 fuels fall within the bounded area.

FIGS. 2A–2D show similar plots of Groups 2A–2D oxygenated reformulated diesel fuels as points within a bounded area in the plane of total cetane and aromatics content. The boundary lines show for each fuel group the essential trade-off between total cetane and aromatics (upper line), the practical limits of fuel manufacture (lower line), and the lower (left) and upper (right) limits to the total cetane number, which may be achieved in part by the use of cetane additives (ignition improvers). The addition of oxygen to the fuel, beyond that which is naturally occurring, has an adverse effect on $NO_x$ emissions that is estimated to be approximately 1 percent increase in $NO_x$ emissions for each 1 percent (wt) of oxygen in the fuel, but it provides a substantial reduction in PM emissions that is estimated to be nearly 5 percent for each 1 percent (wt) of oxygen. The essential trade-off between total cetane number and aromatics content in fuel manufacture is therefore progressively modified as the fuel oxygen content increases.

As seen in FIG. 2A, the presence of fuel oxygen in Group 2A fuels requires a greater reduction in aromatics content at lower total cetane numbers to offset the adverse effects of oxygen on $NO_x$ emissions, when compared to the non-oxygenated Group 1 fuels. At higher total cetane numbers, the reduction in NOx emissions is more than sufficient to offset the adverse NOx effects of oxygen, permitting increased aromatics content in the fuel while retaining substantially reduced PM emissions.

As fuel oxygen content increases in Group 2B-D fuels, the upper boundary line becomes determined primarily by the constraint of $NO_x$ emissions, so that the maximum permissible aromatics content must be progressively reduced compared to reformulated fuels of lesser oxygen content. The bounded area shifts to higher total cetane numbers and lower maximum aromatics content and thereby moves farther from the sample of commercial fuels. Only 3,of the 104 commercial fuels lie within the bounded areas for Group 2A-B fuels, while none of the commercial fuels lie within the bounded areas for Group 2C-D fuels.

All of the fuels of the present invention are produced with measurement and/or control of a subset of properties that are measured and/or controlled in current production of automotive diesel fuel. With production and/or purchase of suitable blendstocks, all of the fuels of the present invention may be readily formulated by those skilled in the art of diesel fuel production.

While the above methodology was used specifically to determine the emissions reductions for HDD engines, the reformulated diesel fuels of the present invention are not limited to use in HDD engines, but are also applicable for use in all automotive diesel engines, including light-duty vehicles (LDVs). With respect to LDVs, considerable interest in diesel technology has resulted from the potential fuel efficiency benefits of diesel engines in LDVs, although there is virtually no diesel engine penetration of the LDV population in the U.S. Future LDV emissions standards are very stringent, and it is currently unclear whether these standards can be attained by diesel technology. Because much of the development work is occurring in Europe, ORNL commissioned a study of LDV diesel engines, fuels, and after-treatment technologies based on interviews with European diesel engine manufacturers and industry research groups that was published in Energy and Environmental Analysis. 2001. *Diesel Technology and Fuel Requirements for Low Emissions: Phase II*, prepared for UT-Battelle, Oak Ridge National Laboratory under Contract 62X-SM489C, Task 18, May 2001, hereinafter incorporated in its entirety by reference. The limited existing data on diesel LDV emissions performance reflect European emissions standards and test procedures and the significantly different characteristics of European diesel fuels. Therefore, only qualitative conclusions could be drawn regarding the effect of fuel properties on the emissions of diesel LDVs certified for the U.S. market.

The diesel LDV study concluded that: (a) engine-out emissions from advanced LDV engine designs remained sensitive to fuel properties including, but not limited to, cetane rating, aromatics content, and specific gravity; (b) the emissions sensitivity, measured on a percentage basis, appeared to be of similar magnitude to that of HDD engines; and (c) NOx reductions of 12 to 15 percent and PM reductions of up to 30 percent, compared to conventional diesel fuel, appeared to be possible from fuels that combine increased cetane rating with reduced aromatics content and specific gravity. Based on these findings, the fuels of the present invention will also reduce $NO_x$ and PM emissions in diesel LDVs. The emissions reductions in LDVs are expected to be of similar magnitude, on a percentage basis, to those determined for HDDs, although further research would be needed to provide quantitative estimates for LDVs.

Thus, it will be seen that reformulated diesel fuels for automotive diesel engines, which meet the requirements of ASTM 975-02 and significantly reduce emissions of nitrogen oxides and particulate matter relative to commercially available diesel fuels, have been provided. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A reformulated oxygenated diesel fuel for automotive diesel engines, said reformulated diesel fuel meeting the requirements of ASTM 975-02 and having:

a) a total cetane number in a range from about 48 to about 75;

b) a cetane improvement number of less than or equal to 20;

c) a minimum aromatics content ($Arom_{min}$) determined as a function of said total cetane number (TCet) by the formula:

$$Arom_{min}=15.00-0.7143*[\min(55,TCet)-48];$$

d) a maximum aromatics content ($Arom_{max}$) determined as a function of said total cetane number (TCet) by the formula:

$$Arom_{max}=-134.28+5.168*TCet-0.04051*TCet^2;$$

e) a sulfur content less than or equal to 500 ppm; and f) an oxygen content in a range of from greater than zero to less than or equal to 1.0 weight percent.

2. The fuel of claim 1, wherein said fuel has a specific gravity less than or equal to 0.861 gm/cm$^3$.

3. The fuel of claim 2, wherein said fuel has an initial boiling point less than or equal to 436° F.

4. The fuel of claim 3, wherein said fuel has a 10 volume percent boiling point less than or equal to 492° F.

5. The fuel of claim 4, wherein said fuel has a 50 volume percent boiling point less than or equal to 570° F.

6. The fuel of claim 5, wherein said fuel has a 90 volume percent boiling point less than or equal to 640° F.

7. The fuel of claim 6, wherein said fuel has a final boiling point less than or equal to 719° F.

8. The fuel of claim 7, wherein for heavy-duty diesel engines, said fuel significantly reduces emissions of nitrogen oxides (NOx) from about 2 to about 12 percent and particulate matter (PM) from about 6 to about 18 percent relative to commercially available diesel fuels.

9. The fuel of claim 1, wherein said fuel has an initial boiling point less than or equal to 436° F.

10. The fuel of claim 1, wherein said fuel has a 10 volume percent boiling point less than or equal to 492° F.

11. The fuel of claim 1, wherein said fuel has a 50 volume percent boiling point less than or equal to 570° F.

12. The fuel of claim 1, wherein said fuel has a 90 volume percent boiling point less than or equal to 640° F.

13. The fuel of claim 1, wherein said fuel has a final boiling point less than or equal to 719° F.

14. The fuel of claim 1, wherein for heavy-duty diesel engines, said fuel significantly reduces emissions of nitrogen oxides (NOx) from about 2 to about 12 percent and particulate matter (PM) from about 6 to about 18 percent relative to commercially available diesel fuels.

15. A reformulated oxygenated diesel fuel for automotive diesel engines, said reformulated diesel fuel meeting the requirements of ASTM 975-02 and having:

a) a total cetane number in a range from about 48 to about 75;

b) a cetane improvement number of less than or equal to 20;

c) a minimum aromatics content ($Arom_{min}$) determined as a function of said total cetane number (TCet) by the formula:

$$Arom_{min}=15.00-0.7143*[min(55,TCet)-48];$$

d) a maximum aromatics content ($Arom_{max}$) determined as a function of said total cetane number (TCet) by the formula:

$$Arom_{max}=-171.68+6.139*TCet-0.04641*TCet^2;$$

e) a sulfur content less than or equal to 500 ppm; and f) an oxygen content in a range of from greater than 1.0 to 2.0 weight percent.

16. The fuel of claim 15, wherein said fuel has a specific gravity less than or equal to 0.861 gm/cm$^3$.

17. The fuel of claim 16, wherein said fuel has an initial boiling point less than or equal to 437° F.

18. The fuel of claim 17, wherein said fuel has a 10 volume percent boiling point less than or equal to 492° F.

19. The fuel of claim 18, wherein said fuel has a 50 volume percent boiling point less than or equal to 575° F.

20. The fuel of claim 19, wherein said fuel has a 90 volume percent boiling point less than or equal to 640° F.

21. The fuel of claim 20, wherein said fuel has a final boiling point less than or equal to 719° F.

22. The fuel of claim 21, wherein for heavy-duty diesel engines, said fuel significantly reduces emissions of nitrogen oxides (NOx) from about 2 to about 10 percent and particulate matter (PM) from about 8 to about 22 percent relative to commercially available diesel fuels.

23. The fuel of claim 15, wherein said fuel has an initial boiling point less than or equal to 437° F.

24. The fuel of claim 15, wherein said fuel has a 10 volume percent boiling point less than or equal to 492° F.

25. The fuel of claim 15, wherein said fuel has a 50 volume percent boiling point less than or equal to 575° F.

26. The fuel of claim 15, wherein said fuel has a 90 volume percent boiling point less than or equal to 640° F.

27. The fuel of claim 15, wherein said fuel has a final boiling point less than or equal to 719° F.

28. The fuel of claim 15, wherein for heavy-duty diesel engines, said fuel significantly reduces emissions of nitrogen oxides (NOx) from about 2 to about 10 percent and particulate matter (PM) from about 8 to about 22 percent relative to commercially available diesel fuels.

29. A reformulated oxygenated diesel fuel for automotive diesel engines, said reformulated diesel fuel meeting the requirements of ASTM 975-02 and having:

a) a total cetane number in a range from about 49 to about 75;

b) a cetane improvement number of less than or equal to 20;

c) a minimum aromatics content ($Arom_{min}$) determined as a function of said total cetane number (TCet) by the formula:

$$Arom_{min}=14.50-0.7500*[min(55,TCet)-49];$$

d) a maximum aromatics content ($Arom_{max}$) determined as a function of said total cetane number (TCet) by the formula:

$$Arom_{max}=-163.37+5.687*TCet-0.04200*TCet^2;$$

e) a sulfur content less than or equal to 500 ppm; and f) an oxygen content in a range of from greater than 2.0 to 3.0 weight percent.

30. The fuel of claim 29, wherein said fuel has a specific gravity less than or equal to 0.861 gm/cm$^3$.

31. The fuel of claim 30, wherein said fuel has an initial boiling point less than or equal to 434° F.

32. The fuel of claim 31, wherein said fuel has a 10 volume percent boiling point less than or equal to 490° F.

33. The fuel of claim 32, wherein said fuel has a 50 volume percent boiling point less than or equal to 570° F.

34. The fuel of claim 33, wherein said fuel has a 90 volume percent boiling point less than or equal to 640° F.

35. The fuel of claim 34, wherein said fuel has a final boiling point less than or equal to 719° F.

36. The fuel of claim 35, wherein for heavy-duty diesel engines, said fuel significantly reduces emissions of nitrogen oxides (NOx) from about 2 to about 10 percent and particulate matter (PM) from about 14 to about 26 percent relative to commercially available diesel fuels.

37. The fuel of claim 29, wherein said fuel has an initial boiling point less than or equal to 434° F.

38. The fuel of claim 29, wherein said fuel has a 10 volume percent boiling point less than or equal to 490° F.

39. The fuel of claim 29, wherein said fuel has a 50 volume percent boiling point less than or equal to 570° F.

40. The fuel of claim 29, wherein said fuel has a 90 volume percent boiling point less than or equal to 640° F.

41. The fuel of claim 29, wherein said fuel has a final boiling point less than or equal to 719° F.

42. The fuel of claim 29, wherein for heavy-duty diesel engines, said fuel significantly reduces emissions of nitrogen oxides (NOx) from about 2 to about 10 percent and particulate matter (PM) from about 14 to about 26 percent relative to commercially available diesel fuels.

43. A reformulated oxygenated diesel fuel for automotive diesel engines, said reformulated diesel fuel meeting the requirements of ASTM 975-02 and having:

a) a total cetane number in a range from about 52 to about 75;

b) a cetane improvement number of less than or equal to 20;

c) a minimum aromatics content ($Arom_{min}$) greater than or equal to 10 volume percent;

d) a maximum aromatics content ($Arom_{max}$) determined as a function of said total cetane number (TCet) by the formula:

$$Arom_{max}=-178.25+5.930*TCet-0.04270*TCet^2;$$

e) a sulfur content less than or equal to 500 ppm; and f) an oxygen content in a range of from greater than 3.0 to 3.5 weight percent.

44. The fuel of claim 43, wherein said fuel has a specific gravity less than or equal to 0.853 gm/cm$^3$.

45. The fuel of claim 44, wherein said fuel has an initial boiling point less than or equal to 433° F.

46. The fuel of claim 45, wherein said fuel has a 10 volume percent boiling point less than or equal to 484° F.

47. The fuel of claim 46, wherein said fuel has a 50 volume percent boiling point less than or equal to 570° F.

48. The fuel of claim 47, wherein said fuel has a 90 volume percent boiling point less than or equal to 640° F.

49. The fuel of claim 48, wherein said fuel has a final boiling point less than or equal to 701° F.

50. The fuel of claim 49, wherein for heavy-duty diesel engines, said fuel significantly reduces emissions of nitrogen oxides (NOx) from about 2 to about 9 percent and particulate matter (PM) from about 20 to about 30 percent relative to commercially available diesel fuels.

51. The fuel of claim 43, wherein said fuel has an initial boiling point less than or equal to 433° F.

52. The fuel of claim 43, wherein said fuel has a 10 volume percent boiling point less than or equal to 484° F.

53. The fuel of claim 43, wherein said fuel has a 50 volume percent boiling point less than or equal to 570° F.

54. The fuel of claim 43, wherein said fuel has a 90 volume percent boiling point less than or equal to 640° F.

55. The fuel of claim 43, wherein said fuel has a final boiling point less than or equal to 701 ° F.

56. The fuel of claim 43, wherein for heavy-duty diesel engines, said fuel significantly reduces emissions of nitrogen oxides (NOx) from about 2 to about 9 percent and particulate matter (PM) from about 20 to about 30 percent relative to commercially available diesel fuels.

* * * * *